United States Patent [19]

Kouchi et al.

[11] Patent Number: 4,566,056

[45] Date of Patent: Jan. 21, 1986

[54] HEADLAMP FOR VEHICLE

[75] Inventors: Tadashi Kouchi, Fuchu; Yoshiharu Urakami, Kawasaki, both of Japan

[73] Assignee: Stanley Electric Co., Ltd., Tokyo, Japan

[21] Appl. No.: 587,573

[22] Filed: Mar. 8, 1984

[51] Int. Cl.[4] ..... F21V 7/00; H01J 5/16

[52] U.S. Cl. ..... 362/297; 362/346; 362/310

[58] Field of Search ..... 362/297, 296, 304, 346, 362/310, 347, 350

[56] References Cited

U.S. PATENT DOCUMENTS

| | | | |
|---|---|---|---|
| 3,688,149 | 8/1972 | Pitkjaun | 362/297 |
| 3,871,751 | 3/1975 | Rambauske et al. | 362/296 |
| 4,149,229 | 4/1979 | Draper | 362/346 |
| 4,351,018 | 9/1982 | Frathy | 362/297 |
| 4,420,801 | 12/1983 | Reiling et al. | 362/310 |
| 4,447,865 | 5/1984 | Van Horn et al. | 362/297 |
| 4,494,176 | 1/1985 | Sands et al. | 362/297 |

*Primary Examiner*—Raymond A. Nelli
*Attorney, Agent, or Firm*—Ezra Sutton

[57] ABSTRACT

The present invention discloses a headlamp for a vehicle of a construction in which two paraboloidal surfaces of a reflector are different at upper surface and lower surface thereof as viewed from a line corresponding to a predetermined boundary line, a focal point on the upper surface side is positioned ahead of a focal point on the lower surface side, and approximately the center of the main filament is arranged to be positioned at the focal point of the lower surface side.

4 Claims, 10 Drawing Figures

HEADLAMP FOR VEHICLE

SUMMARY OF THE INVENTION

The present invention relates to a headlamp for a vehicle comprising a main filament and a sub-filament, which are longitudinally disposed, a backing plate being arranged below the sub-filament, and particularly to the construction of a reflector thereof.

DESCRIPTION OF THE PRIOR ART

One example of a conventional headlamp for a vehicle is shown in FIGS. 1 and 2. Reference numeral 1 designates a reflector having a paraboloidal surface, 2 a main filament, 3 a sub-filament and 4 a backing plate arranged below the sub-filament 3. The main filament 2 is arranged so that the tip portion of the main filament is positioned about 0.6 to 0.8 mm ahead of the focal point f of the paraboloidal surface of the reflector 1, and the sub-filament 3 is arranged ahead of the main filament. The filaments 2 and 3 are arranged in coincidence with a rotating axis of the paraboloidal surface. The reflector 1 has two paraboloidal surfaces (there is also a paraboloidal surface having the focal distance $F_1'$ alone) having the focal distances $F_1'$, $F_2'$ but these focal points are one point f, which has the shape termed as the so-called homofocus.

Where the filaments are arranged as described above, a spot pattern of the main beam is large and a low luminous flux density results. This results from the fact that light at the tip portion of the filament, which is substantially parallel light, is reflected by the reflector but light is reflected while being diffused as it comes closer to a portion away from the focal point f, that is, to the rear end of the filament.

To make the spot pattern of the main beam a spot pattern of high luminuous intensity, when the substantially center of the main filament 2 is positioned at the focal point f, distribution of light shown in FIG. 8 (*a*) can be obtained but in this case, a central dark portion of the sub-beam pattern becomes large (see FIG. 8 (*b*)). Therefore, the desired light-distribution pattern has been heretofore formed by a lens prism from the aforementioned spot state. However, in the event that "out of position" in positional relation between the focal point and filament occurs due to the position of the filament, unevenness of the reflector or the like, a deviation occurs in characteristic of light distribution, resulting in so-called "out of focus" and thus a shortage of luminous intensity. This possibly impairs the safety of the running vehicle.

OBJECT OF THE INVENTION

The present invention has been achieved in consideration of the disadvantages noted above with respect to prior arts, and an object of the invention is to provide a headlamp for a vehicle wherein paraboloidal surfaces of a reflector are different at upper surface and lower surface thereof as viewed from a line corresponding to a predetermined boundary line, a focal point on the upper surface side is formed to be positioned 0.5 to 4 mm ahead of a focal point on the lower surface side, and approximately the center of a main filament is arranged to be positioned at the focal point of the lower surface side to thereby obtain a pattern of light distribution having a high luminous intensity.

DETAILED DESCRIPTION OF THE INVENTION

The present invention will now be described in detail with reference to the drawings.

Figure 1:
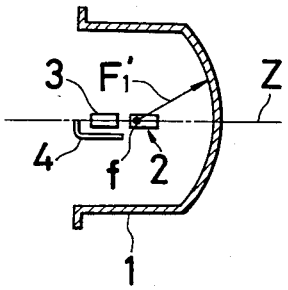
FIG. 1 PRIOR ART
FIGS. 1 and 2 are respectively sectional views showing one example of a conventional headlamp for a vehicle.
Figure 2:
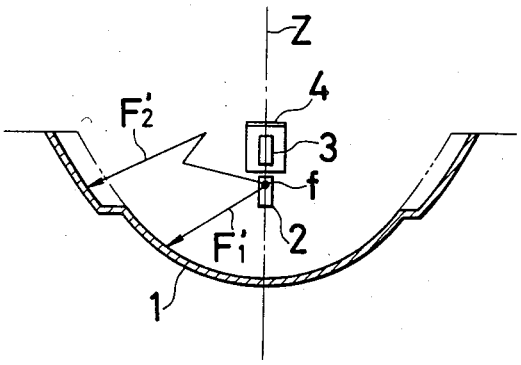
FIG. 2 PRIOR ART
Figure 3:
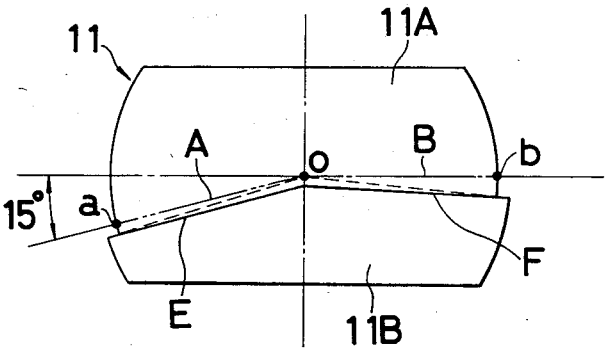
FIGS. 3 to 5 are respectively views showing one embodiment of a head lamp for a vehicle in accordance with the present invention, FIG. 3 being an explanatory view in which a reflector is viewed from the front, FIG. 4 being a sectional view of the reflector and FIG. 5 being an enlarged sectional view showing the arranging state of two filaments.
Figure 4:
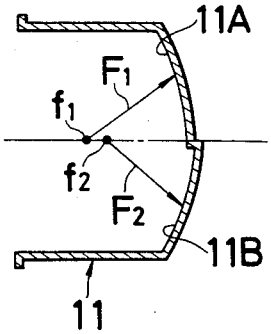
Figure 5:
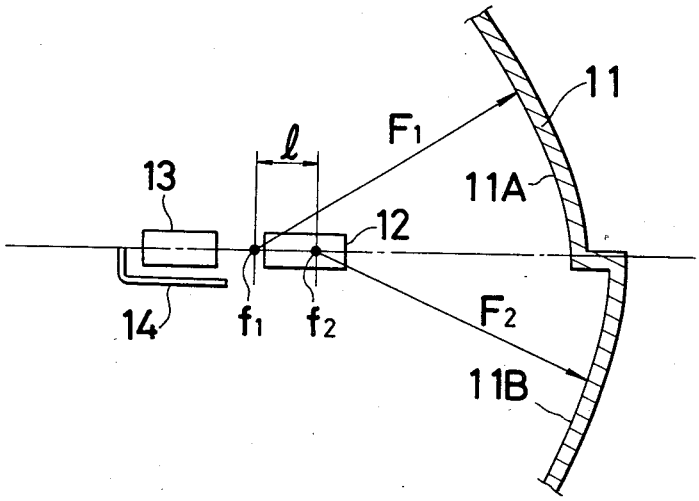

FIGS. 3 to 5 are views showing one embodiment of the present invention, in which figures, reference numeral 11 designates a reflector, 12 a main filament, 13 a sub-filament, and 14 a backing plate arranged below the sub-filament 13. The reflector 11 has a paraboloidal surface 11*a* of a focal distance $F_1$ and a paraboloidal surface 11B of a focal distance $F_2$, the reflector being formed so as to have a distance $l=0.5$ to 4 mm between two focal points $f_1$ and $f_2$ ($f_1$ is positioned ahead of $f_2$). Boundaries between both the paraboloidal surfaces 11A and 11B are established as in lines E, F shown in FIG. 3.

Figure 10:
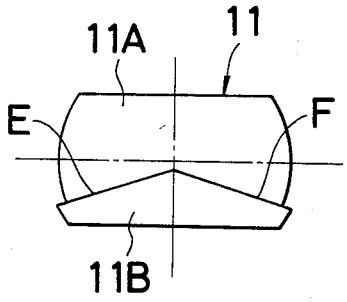
FIG. 10 is an explanatory view of a reflector which serves for both right-side and left-side passages of the vehicle.

Here, a point O designates the center of the lamp, a point wherein a line A lowered by 15° from a horizontal line B passing through the center O intersects with the outermost edge of the paraboloidal surface is indicated at a, and a point wherein the horizontal line B passing through the center O intersects with the outermost edge of the paraboloidal surface. The position where the sub-beam is projected on the reflector is above a line which connects points a, o and b, and an angle 15° is the shield angle of filament. This angle sometimes exceeds 15° as shown by the dotted line due to the unevenness of arrangement of the filament. Similarly, also on the side of the horizontal line at right-hand of FIG. 3, the angle is sometimes lowered rightwards (see the dotted line). Accordingly, the boundary between the paraboloidal surfaces 11A and 11B is necessary to be provided below the folded lines a, o and b. It will be noted that FIG. 3 shows the case of the vehicle for the left-side passage, and in case of the vehicle for the right-side passage, a symmetrical shape to left and right relative to FIG. 3 can be used. In case of the reflector for the headlamp which serves for both vehicles for right and left side passages, the arrangement of FIG. 10 can be used.

Figure 6:
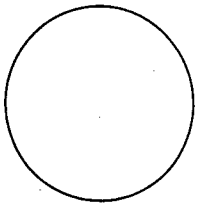
FIG. 6 (a) PRIOR ART
FIGS. 6 (*a*) and (*b*) to FIGS. 9 (*a*) and (*b*) show spot patterns of a main beam and a sub-beam.
Figure 6:
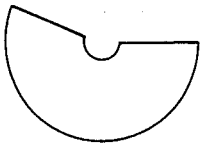
FIG. 6 (b) PRIOR ART
Figure 7:
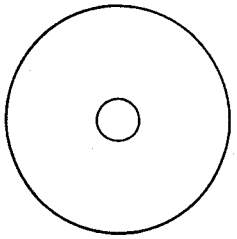
Figure 7:
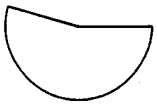
Figure 8:
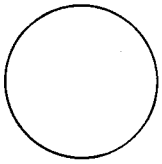
Figure 8:
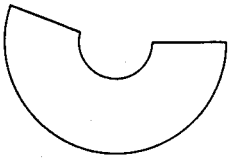
Figure 9:
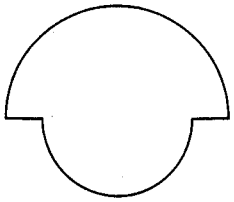
Figure 9:
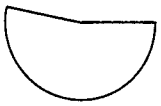

If the headlamp is constructed as described above, approximately the center of the main filament 12 is positioned at the focal point $f_2$ of the paraboloidal surface 11B on the lower surface side of the reflector 11, and therefore, the spot pattern of the main beam is smallest in angle of diffusion, and the area of the spot pattern is reduced to increase the luminous flux density. FIG. 9 (*a*) shows said spot pattern, which is the configuration comprising a combination of an approximately upper half of a spot pattern (see FIG. 7 (*a*)) where the focal point is positioned ahead of the end of the main filament 12 and an approximately lower half of a spot pattern (see FIG. 8 (*a*)) where the focal point is positioned at the center of the main filament. In this case, the spot pattern of the sub-beam will be a pattern in which a dark portion is not present in the central portion of the spot pattern, an area of the pattern is small and the pattern is bright, as shown in FIG. 9 (*b*), similar to the case where the focal point is positioned ahead of the main filament 2 (see FIG. 7 (*b*)). That is, for both main beam and sub-beam, the illumination will be brighter than the prior art shown in FIGS. 6 (*a*) and (*b*). Thus, the light distribution pattern formed by the lens prism will have the high luminous intensity.

Moreover, the focal points of two paraboloidal surfaces of the upper surface 11A and lower surface 11B of the reflector 11 are made different in position, whereby the positional relation between the longitudinally disposed main filament and sub-filament and the focal points becomes close. Accordingly, even if slight unevenness is present in position of filaments or reflector, the light distribution characteristic is less affected and the out of focus rarely occurs, thus providing a headlamp which is high in safety of the running vehicle.

As described above, in accordance with the present invention, the reflector 11 is formed so as to have two paraboloidal surfaces 11A and 11B whose focal points are two points having a predetermined spacing l and the filaments are arranged so that the main filament 12 and sub-filament 13 are in a suitable positional relation with two focal points $f_1$, $f_2$, and therefore, it is possible to provide a headlamp in which both the main filament and sub-filament have the light distribution pattern of high luminous intensity.

Furthermore, in carrying out the present invention, it will be noted that in place of the construction in which the filaments are directly arranged within the reflector as shown in the illustrated embodiment, a construction can be employed in which a bulb is mounted within a reflector.

What is claimed is:

1. A headlamp for a vehicle comprising:

a reflector having a main filament and a sub-filament disposed on the same axis;

said reflector having a first paraboloidal surface having a first focal distance and a second paraboloidal surface having a second focal distance;

said reflector having first and second focal points disposed on the same longitudinal axis and defined by said first and second focal distances;

said reflector having a space of 0.5 to 4 mm between said first and second focal points; and said second focal point being located at the same location as said main filament.

2. A headlamp for a vehicle according to claim 1 wherein the headlamp has a construction in which approximately the center of the main filament is positioned at the focal point of the paraboloidal surface on the lower surface side of the reflector whereby a spot pattern of a main beam is smallest in angle of diffusion to increase the luminous flux density.

3. A headlamp for a vehicle according to claim 1 wherein the filaments are arranged so that the main filament and sub-filament are in a suitable positional relation with two focal points whereby even if slight unevenness is present in position of the filaments or reflector, the out of focus rarely occurs.

4. A headlamp for a vehicle according to claim 1 wherein the headlamp can be also constructed such that a bulb in place of filaments is mounted within the relfector.

* * * * *